US007880534B2

(12) United States Patent
Huang et al.

(10) Patent No.: US 7,880,534 B2
(45) Date of Patent: Feb. 1, 2011

(54) REFERENCE CIRCUIT FOR PROVIDING PRECISION VOLTAGE AND PRECISION CURRENT

(75) Inventors: Din-Jiun Huang, Hsinchu (TW); Kuan-Yu Chen, Hsinchu (TW); Yuan-Hsun Chang, Hsinchu (TW)

(73) Assignee: Faraday Technology Corp., Science-Based Industrial Park, Hsin-Chu (TW)

( * ) Notice: Subject to any disclaimer, the term of this patent is extended or adjusted under 35 U.S.C. 154(b) by 0 days.

(21) Appl. No.: 12/437,699

(22) Filed: May 8, 2009

(65) Prior Publication Data

US 2010/0060345 A1 Mar. 11, 2010

(30) Foreign Application Priority Data

Sep. 8, 2008 (TW) ..... 97134441 A

(51) Int. Cl.
*G05F 1/56* (2006.01)
*G05F 3/26* (2006.01)

(52) U.S. Cl. ..... 327/539; 327/512; 327/543; 323/314; 323/316

(58) Field of Classification Search ..... None
See application file for complete search history.

(56) References Cited

U.S. PATENT DOCUMENTS 5,838,188 A * 11/1998 Taguchi ..... 327/530
6,087,820 A * 7/2000 Houghton et al. ..... 323/315
6,744,304 B2 * 6/2004 Egerer et al. ..... 327/540
7,123,081 B2 * 10/2006 Lyon ..... 327/543
7,382,180 B2 * 6/2008 Chen ..... 327/543
7,439,601 B2 * 10/2008 Hartley ..... 257/467
2008/0238530 A1 * 10/2008 Ito et al. ..... 327/513

FOREIGN PATENT DOCUMENTS

WO 9105301 4/1991
WO 9720262 6/1997

OTHER PUBLICATIONS

Rasoul Dehghani and S. M. Atarodi;A New Low Voltage Precision CMOS Current Reference With No External Components; IEEE Transactions on Circuits and Systems—II: Analog and Digital Signal Processing, vol. 50, No. 12, Dec. 2003; pp. 928-932.

* cited by examiner

*Primary Examiner*—Lincoln Donovan
*Assistant Examiner*—Terry L Englund
(74) *Attorney, Agent, or Firm*—Winston Hsu; Scott Margo

(57) ABSTRACT

A reference circuit for providing a precision voltage and a precision current includes a bandgap voltage reference circuit, a positive temperature coefficient calibrating circuit, a threshold voltage superposing circuit and precision current generator interconnected in cascade. From the bandgap voltage reference circuit, a bandgap voltage is outputted as the precision voltage, and a PTAT current is outputted to the positive temperature coefficient calibrating circuit along with the bandgap voltage for generating a PTAT voltage. In response to the PTAT voltage from the positive temperature coefficient calibrating circuit, the threshold voltage superposing circuit generates a first voltage which is equal to the PTAT voltage plus a threshold voltage. Then the precision current generator outputs a reference current as the precision current in response to the first voltage.

12 Claims, 7 Drawing Sheets

REFERENCE CIRCUIT FOR PROVIDING PRECISION VOLTAGE AND PRECISION CURRENT

FIELD OF THE INVENTION

The present invention relates to a reference circuit, and more particularly, to a reference circuit for providing both a precision voltage and a precision current.

BACKGROUND OF THE INVENTION

In the design of high-speed I/O circuits such as USB interfaces or SATA interfaces, it is necessary to use a precision voltage and a precision current as references for impedance matching. Please refer to FIG. 1, which is a diagram illustrating a reference circuit capable of providing a precision voltage and a precision current according to prior art. As shown, an IC circuit 10 includes a bandgap voltage reference circuit 12, an operational amplifier 14, a mirroring circuit 16, a transistor $M_1$, and an I/O pad 18.

Generally speaking, the bandgap reference circuit 12 is used for providing a stable bandgap voltage ($V_{BG}$), which will not change as the manufacturing process, the temperature or the supply voltage changes. Therefore, the bandgap voltage $V_{BG}$ outputted by the bandgap voltage reference circuit 12 can be viewed as a precision voltage. As shown in FIG. 1, the bandgap voltage $V_{BG}$ is inputted to a positive input terminal of the operational amplifier 14, and a negative input terminal of the operational amplifier 14 is connected to the I/O pad 18 of the IC circuit 10. In addition, the drain of the transistor $M_1$ is connected to a first terminal of the mirroring circuit 16, the gate of the transistor $M_1$ is connected to the output terminal of the operational amplifier 14, and the source of the transistor $M_1$ is connected to the I/O pad 18 of the IC circuit 10. The IC circuit 10 further utilizes an external precision resistor $R_P$ connected between the I/O pad 18 and ground.

Obviously, when the operational amplifier 14 operates normally, the voltage at the I/O pad 18 of the IC circuit 10 will be the bandgap voltage $V_{BG}$ and thus a first current $I_1$ flowing through the external precision resistor $R_P$ is ($V_{BG}/R_P$). In addition, this first current $I_1$ is outputted through the first terminal of the mirroring circuit 16, and the second terminal of the mirroring circuit 16 can also output a reference current $I_{ref}$, which is directly proportional to the first current $I_1$ and can be viewed as a precision current. In other words, the intensity of the precision current can be determined according to the resistance of the external precision resistor $R_P$.

According to the prior art, in order to obtain both the precision voltage and the precision current in the same circuitry, the I/O pad 18 is designed in the IC circuit 10 and connected to the external precision resistor $R_P$ to generate the precision current. In other words, an external precision resistor is required and needs to be additionally disposed on the circuit board, which results in inefficient problems in space and cost.

In addition, due to the I/O pad 18 being designed in the IC circuit 10, the designer of the IC circuit 10 must design an electrostatic discharge protection circuit (ESD) to protect the I/O pad 18. Accordingly, the layout area of the IC circuit 10 is increased. If the I/O pad 18 is disposed in the IC circuit 10, another problem of generating noise on the I/O pad 18 might be caused.

Furthermore, the stability of the operational amplifier 14 is decided by its phase margin. If the operational amplifier 14 is unstable, the parasitic capacitance on the I/O pad 18 is hard to be estimated, which might result in loop instability and loop oscillation.

In order to obtain the precision voltage and the precision current, a reference voltage distribution system is disclosed in the International Patent Application No. PCT/US90/05473. This system generates a precision current according to an external reference voltage and a controllable resistance. However, this system needs an additional control circuit for controlling the resistance.

In addition, a dual source for constant current and PTAT (proportional to absolute temperature) current is disclosed in the International Patent Application No. PCT/US96/18048, wherein a bandgap voltage reference circuit is used to generate a bandgap reference voltage ($V_{BG}$) and a PTAT voltage ($V_{PTAT}$), and thereby generate the precision current and the PTAT current. Likewise, an external precision resistor is still needed in order to generate the precision current and the PTAT current.

Moreover, in the periodical "IEEE TRANSACTIONS ON CIRCUITS AND SYSTEMS", vol. 50, no. 12, Dec. 2003, a new low voltage precision CMOS current reference circuit with no external components is proposed. Please refer to FIG. 2. FIG. 2 is a diagram illustrating a circuitry disposed in an IC circuit and capable of providing a precision current according to the prior art. The IC circuit 30 includes a bandgap voltage reference circuit 32 with a positive temperature coefficient, an operational amplifier 34, a mirroring circuit 36, and transistors $M_1$, $M_2$ and $M_3$.

The bandgap voltage reference circuit 32 with positive temperature coefficient is used for providing a temperature-dependent bandgap voltage ($V_{BG}$), which increases as the temperature rises. As shown in FIG. 2, the bandgap voltage $V_{BG}$ is inputted to the positive input terminal of the operational amplifier 34, and the negative input terminal of the operational amplifier 34 is connected to the drain of the transistor $M_1$. In addition, the drain of the transistor $M_3$ is connected to a first terminal of the mirroring circuit 36, the gate of the transistor $M_3$ is connected to the output terminal of the operational amplifier 34, and the source of the transistor $M_3$ is connected to the drain of the transistor $M_1$. The source of the transistor $M_1$ is grounded, and the gate of the transistor $M_1$ is connected to the gate of the transistor $M_2$. The source of the transistor $M_2$ is grounded, and the gate and the drain of the transistor $M_2$ are connected to a second terminal of the mirroring circuit 36.

In the IC circuit 30, the transistor $M_1$ has to be operated in a triode region and the transistor $M_2$ has to be operated in a saturation region to make the transistor $M_1$ exhibit a feature of negative temperature coefficient. Hence, by collocating the bandgap voltage ($V_{BG}$) with the positive temperature coefficient and the transistor $M_1$ with the negative temperature coefficient, a precise first current $I_1$ can be generated. In addition, with the first current $I_1$ being outputted from the first terminal of the mirroring circuit 36, a reference current $I_{ref}$ is outputted from the second terminal of the mirroring circuit 36 The reference current $I_{ref}$ is directly proportional to the first current $I_1$ and can be viewed as a precision current.

Although providing a precision current, the abovementioned circuitry does not provide any precision voltage. Hence, an additional bandgap voltage reference circuit is required to provide a temperature-independent bandgap voltage ($V_{BG}$). In addition, due to possible deviations rendered by mass production in the manufacturing process of the IC circuit, it is difficult to control the transistor $M_1$ to be operated in the triode region.

SUMMARY OF THE INVENTION

It is therefore one of the objectives of the present invention to provide a reference circuit disposed in an IC circuit for providing both a precision voltage and a precision current with transistors of the reference circuit all operating in saturation regions.

According to an exemplary embodiment of the present invention, a reference circuit for providing both a precision voltage and a precision current is provided. The reference circuit includes a bandgap voltage reference circuit outputting a bandgap voltage as the precision voltage at a first voltage output terminal and outputting a PTAT current at a current output terminal in response to a power supply; a positive temperature coefficient calibrating circuit connected to the first voltage output terminal and the current output terminal of the bandgap voltage reference circuit for generating a PTAT voltage at a second voltage output terminal in response to the bandgap voltage and the PTAT current; a threshold voltage superposing circuit connected to the second voltage output terminal of the positive temperature coefficient calibrating circuit for generating a first voltage at a third voltage output terminal in response to the PTAT voltage, wherein the first voltage is generated according to (or equals to) the PTAT voltage plus a threshold voltage; and a precision current generator connected to the third voltage output terminal of the threshold voltage superposing circuit for outputting a reference current as the precision current at a reference current output terminal in response to the first voltage.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF THE PREFERRED EMBODIMENT

Figure 1:
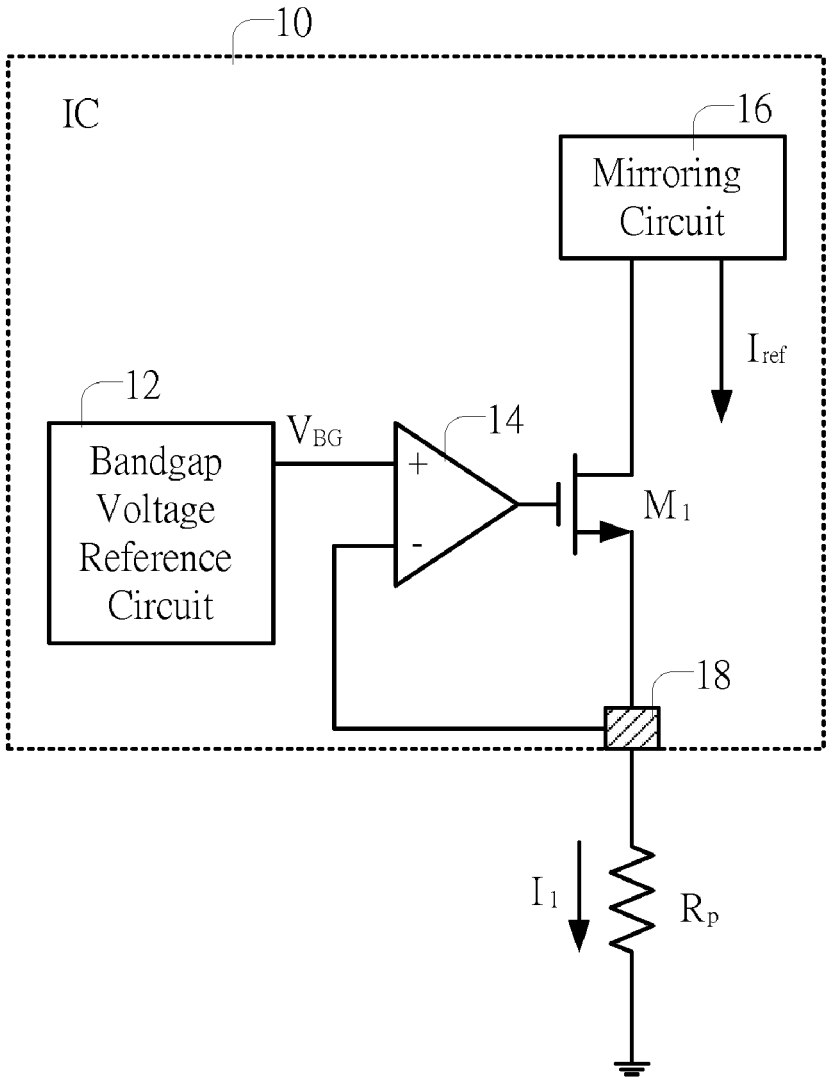
FIG. 1 (PRIOR ART)
FIG. 1 is a diagram illustrating a reference circuit capable of providing a precision voltage and a precision current according to prior art.
Figure 2:
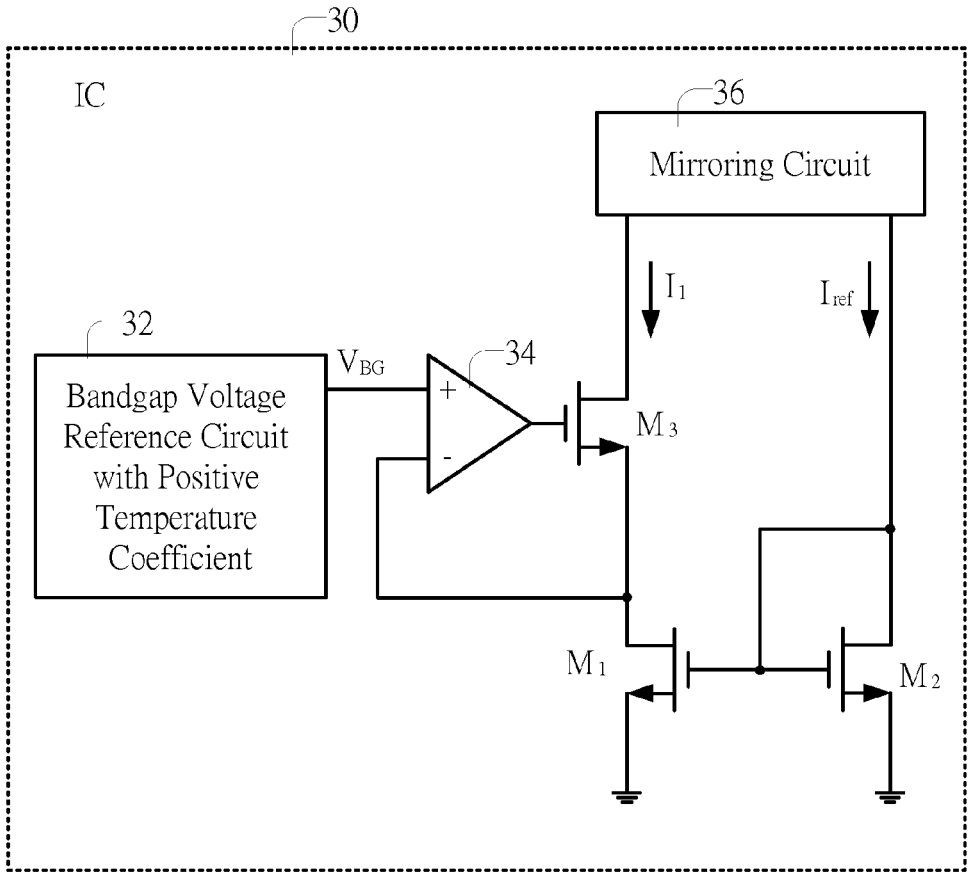
FIG. 2 (PRIOR ART)
FIG. 2 is a diagram illustrating a circuit disposed in an IC circuit and capable of providing a precision current according to another prior art.
Figure 3:
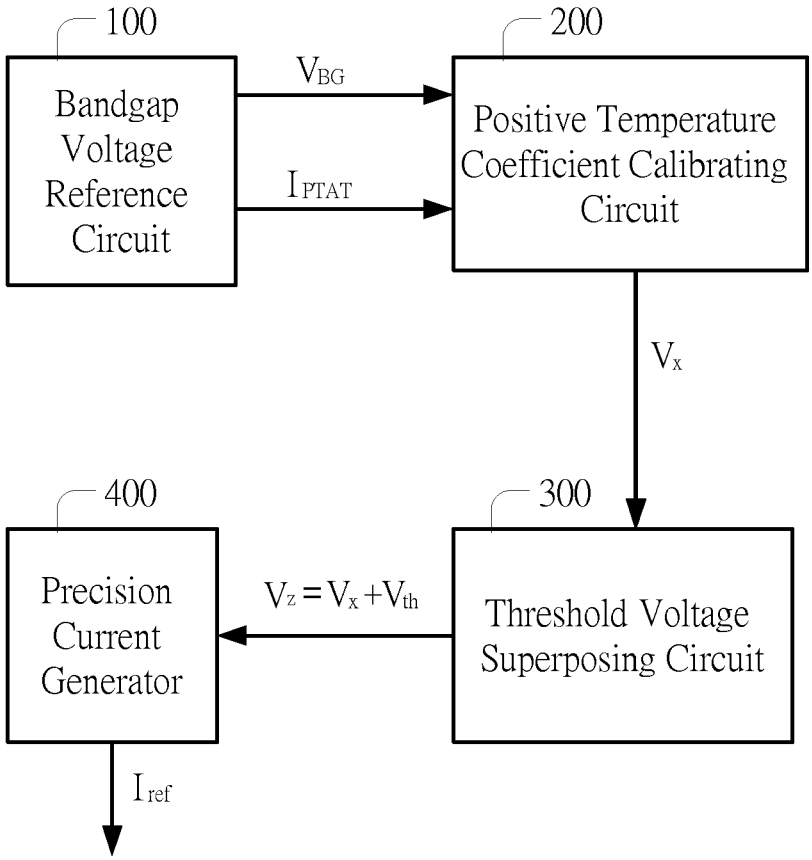
FIG. 3 is a diagram illustrating a reference circuit capable of providing both a precision voltage and a precision current according to an embodiment of the present invention.

Please refer to FIG. 3, which is a diagram illustrating a reference circuit capable of providing both a precision voltage and a precision current according to an embodiment of the present invention. The reference circuitry includes a bandgap voltage reference circuit 100, a positive temperature coefficient calibrating circuit 200, a threshold voltage superposing circuit 300, and a precision current generator 400. The details of respective circuits are described hereinafter with reference to FIG. 4~FIG. 7.

Figure 4:
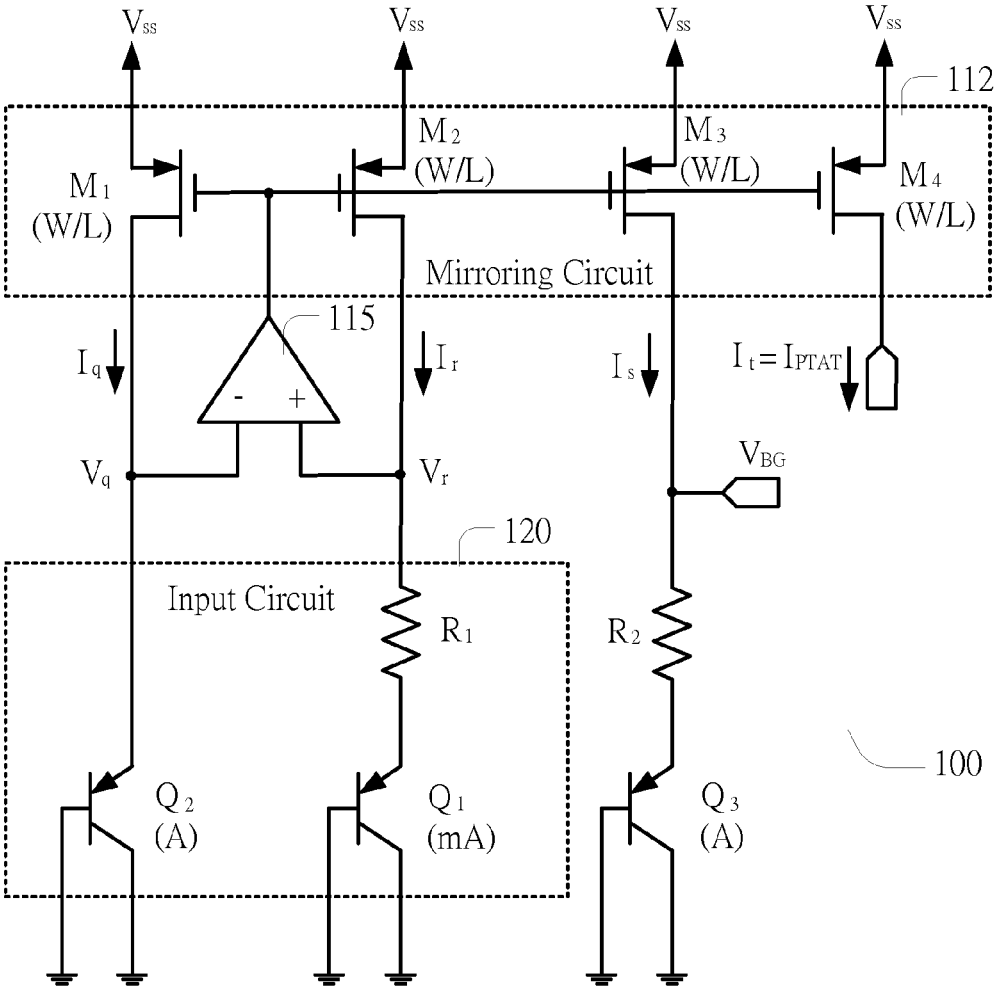
FIG. 4 is a diagram showing an embodiment of a bandgap voltage reference circuit applicable to the reference circuit of FIG. 3.

FIG. 4 illustrates an embodiment of the bandgap voltage reference circuit 100. The bandgap voltage reference circuit 100 includes PMOS field-effect transistors, PNP bipolar transistors and operational amplifiers constituting a first mirroring circuit 112, a first operational amplifier 115 and an input circuit 120. The mirroring circuit 112 includes four PMOS field-effect transistors (FET) $M_1$, $M_2$, $M_3$ and $M_4$. In this embodiment, the four PMOS FETs $M_1$, $M_2$, $M_3$ and $M_4$ have the same aspect ratio (W/L). The gates of the four PMOS FETs $M_1$, $M_2$, $M_3$ and $M_4$ are connected to each other, the sources of the four PMOS FETs $M_1$, $M_2$, $M_3$ and $M_4$ are coupled to a power supply ($V_{SS}$), and from the drains of the four PMOS FETs $M_1$, $M_2$, $M_3$ and $M_4$, output currents $I_q$, $I_r$, $I_s$, and $I_t$ are respectively outputted. Moreover, an output terminal of the first operational amplifier 115 is connected to the gates of the PMOS FETs $M_1$, $M_2$, $M_3$ and $M_4$, a positive input terminal of the first operational amplifier 115 is connected to the drain of the PMOS FET $M_2$, and a negative input terminal of the first operational amplifier 115 is connected to the drain of the PMOS FET $M_1$. On the other hand, the input circuit 120 includes two PNP bipolar transistors (BJT) $Q_1$ and $Q_2$. The bases and collectors of the BJTs $Q_1$ and $Q_2$ are grounded to make $Q_1$ and $Q_2$ diode-connected. The emitter of the BJT $Q_2$ is connected to the negative input terminal of the first operational amplifier 115, and a first resistor $R_1$ is connected between the emitter of the BJT $Q_1$ and the positive input terminal of the first operational amplifier 115. In addition, the area of the PNP BJT $Q_3$ is the same as the area of the BJT $Q_2$. The base and the collector of the BJT $Q_3$ are grounded; a second resistor $R_2$ is connected between the emitter of the BJT $Q_3$ and the drain of $M_3$; and from the drain of $M_3$, a bandgap voltage ($V_{BG}$) is outputted.

Since the four PMOS FETs $M_1$, $M_2$, $M_3$ and $M_4$ have the same aspect ratio, the current $I_q$ outputted from the drain of the PMOS FET $M_1$, the current $I_r$ outputted from the drain of the PMOS FET $M_2$, the current $I_s$ outputted from the drain of the PMOS FET $M_3$, and the current $I_t$ outputted from the drain of the PMOS FET $M_4$ are substantially equal when the PMOS FETs $M_1$, $M_2$, $M_3$ and $M_4$ operate in saturation regions, as expressed by the following equation:

$$I_q=I_r=I_s=I_t \quad (1).$$

If the first operational amplifier 115 has an infinite (or substantially large) gain, which means a voltage $V_q$ at the negative input terminal of the operational amplifier 115 is equal to a voltage $V_r$ at the positive input terminal of the operational amplifier 115, so that the following equation is complied with:

$$R_1 I_r + V_{EB1} = V_{EB2} \quad (2),$$

where $V_{EB1}$ is an emitter-base voltage of the BJT $Q_1$; and $V_{EB2}$ is an emitter-base voltage of the BJT $Q_2$.

As the BJTs $Q_1$ and $Q_2$ are diode-connected and on a condition that the area of the BJT $Q_1$ is m times the area of the BJT Q2, it is realized that $$I_q = I_{s0} e^{\frac{V_{EB2}}{V_t}} \text{ and } I_r = m I_{s0} e^{\frac{V_{EB1}}{V_t}},$$

where $I_{S0}$ is a saturation current of the BJT $Q_2$ and $V_t$ represents a thermal voltage. Accordingly, the following equations are obtained:

$$V_{BE1}=V_t\cdot\ln(I_r/mI_{s0}) \quad (3), \text{ and}$$

$$V_{BE2}=V_t\cdot\ln(I_q/I_{s0}) \quad (4).$$

By combining the equations (1), (2), (3) and (4), the following equations are obtained:

$$I_r=(1/R_1)\cdot V_t\cdot\ln(m) \quad (5),$$

and $$V_{BG}=(R_2/R_1)\cdot V_t\cdot\ln(m)+V_{EB3} \quad (6),$$

where $V_{EB3}$ is an emitter-base voltage of the BJT $Q_3$.

As can be realized from the equation (6), the bandgap voltage $V_{BG}$ is equal to the emitter-base voltage $V_{EB3}$ of the BJT $Q_3$ plus a product of the thermal voltage ($V_t$) multiplying a temperature-independent scalar $C_1$, wherein $C_1=(R_2/R_1)\cdot\ln(m)$. As the emitter-base voltage $V_{BE3}$ exhibits a feature of negative temperature coefficient and the thermal voltage $V_t$ exhibits a feature of positive temperature coefficient, the bandgap voltage $V_{BG}$ with a zero temperature coefficient can be obtained as a result of the addition of the thermal voltage ($V_t$) with a weighing factor, i.e. the constant $C_1$, and the emitter-base voltage $V_{BE3}$. In other words, the bandgap voltage $V_{BG}$ is substantially a constant at whichever temperature. In other words, the bandgap voltage $V_{BG}$ will not change with temperature.

On the other hand, according to the equation (5), $I_r$ is equal to a product of the thermal voltage $V_t$ multiplying a temperature-independent scalar $C_2$, wherein $C_2=(1/R_1)\cdot\ln(m)$. Since the thermal voltage $V_t$ exhibits a feature of positive temperature coefficient, $I_r$ will increase as the temperature rises. Hence, $I_r$ is also called as a proportional to absolute temperature (PTAT) current ($I_{PTAT}$). Further according to the equation (1), i.e. $I_q=I_r=I_s=I_t$, the output $I_t$ from the current output terminal of the bandgap voltage reference circuit 100 is equal to the PTAT current $I_{PTAT}$. Then the output current $I_{PTAT}$, along with the bandgap voltage $V_{BG}$ outputted from a first voltage output terminal of the bandgap voltage reference circuit 100, is provided to next stage of the reference circuitry, i.e. the positive temperature coefficient calibrating circuit 200.

It is understood to those skilled in the art that the bandgap voltage reference circuit 100 is just an embodiment of circuit applicable to the reference circuitry of the present invention. Other suitable electronic components can be used in other embodiments of the bandgap voltage reference circuit to provide bandgap voltage $V_{BG}$ and PTAT current $I_{PTAT}$ for downstream circuits. For example, another embodiment of the bandgap voltage reference circuit can be implemented with all MOS transistors.

Figure 5:
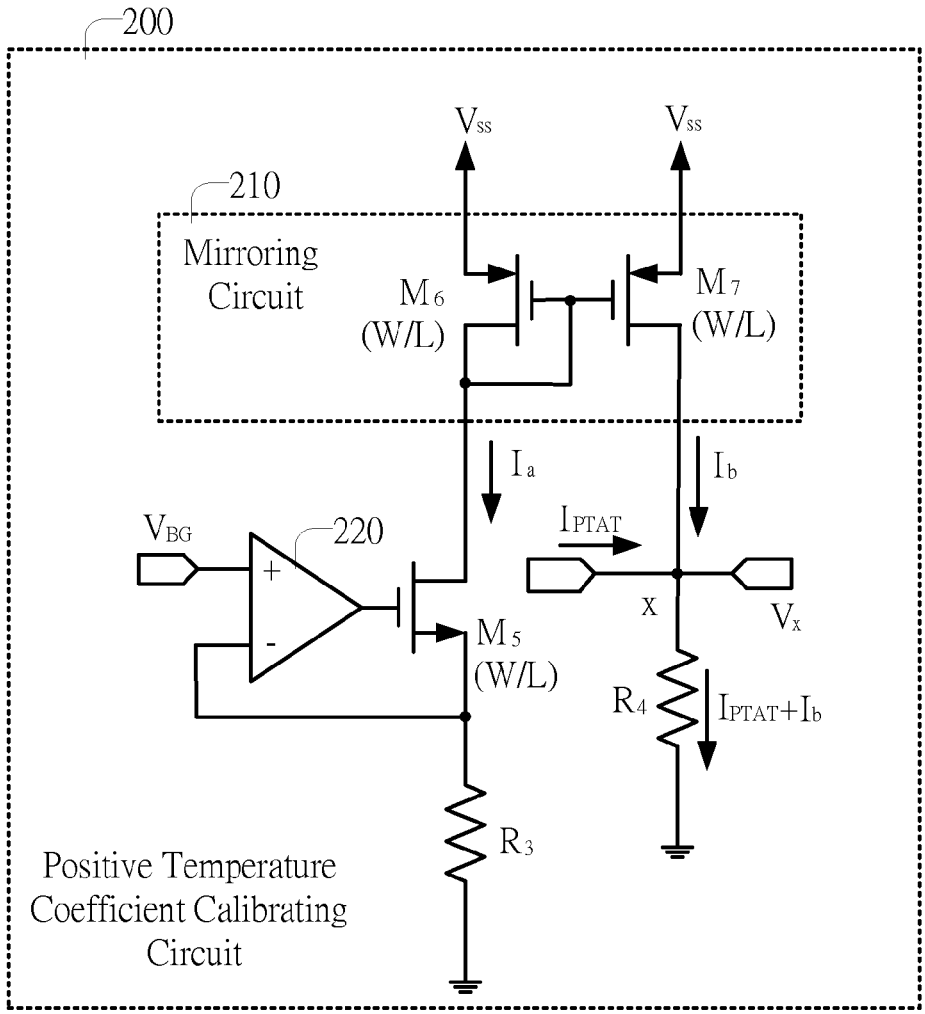
FIG. 5 is a diagram showing an embodiment of a positive temperature coefficient calibrating circuit applicable to the reference circuit of FIG. 3.

Please refer to FIG. 5. FIG. 5 is a diagram showing an embodiment of the positive temperature coefficient calibrating circuit 200. The positive temperature coefficient calibrating circuit 200 includes a second mirroring circuit 210, a second operational amplifier 220, an NMOS FET $M_5$, a third resistor $R_3$, and a fourth resistor $R_4$. The second mirroring circuit 210 includes two PMOS FETs $M_6$ and $M_7$. In this embodiment, the PMOS FETs $M_6$ and $M_7$ have the same aspect ratio (W/L). The gates of the PMOS FETs $M_6$ and $M_7$ are connected to each other, the sources of the PMOS FETs $M_6$ and $M_7$ are connected to the power supply $V_{SS}$; the drain of the PMOS FET $M_6$ is connected to the gate of the PMOS FET $M_6$ and can be viewed as a first terminal of the second mirroring circuit 210; and the drain of the PMOS FET $M_7$ can be viewed as a second terminal of the second mirroring circuit 210. When the PMOS FETs $M_6$ and $M_7$ operate in saturation regions, the intensities of the currents outputted from the first terminal and the second terminal of the second mirroring circuit 210 are equal, i.e. $I_a=I_b$.

A positive input terminal of the second operational amplifier 220 is connected to the first voltage output terminal of the bandgap voltage reference circuit 100 for receiving the bandgap voltage $V_{BG}$, and the negative input terminal of the second operational amplifier 220 is connected to the source of the NMOS FET $M_5$. The drain of the NMOS FET $M_5$ is connected to the first terminal of the second mirroring circuit 210; the gate of the NMOS FET $M_5$ is connected to the output terminal of the second operational amplifier 220; and the third resistor $R_3$ is coupled between the source of the NMOS FET $M_5$ and ground. The second terminal of the second mirroring circuit 210 can be viewed as the second voltage output terminal x of the positive temperature coefficient calibrating circuit 200, which is connected to the current output terminal of the bandgap voltage reference circuit 100 and coupled to ground through the fourth resistor $R_4$.

Obviously, when the second operational amplifier 220 operates normally, the voltage at the negative input terminal of the second operational amplifier 220 is equal to the bandgap voltage $V_{BG}$. Hence, $I_a$ equals to $V_{BG}/R_3$. In addition, the current $I_a$ outputted from the first terminal of the second mirroring circuit 220 and the current $I_b$ outputted from the second terminal of the second mirroring circuit 220 are equal. Furthermore, since the second voltage output terminal x is connected to the current output terminal of the bandgap voltage reference circuit 100, the current flowing through the fourth resistor $R_4$ is ($I_{PTAT}+I_b$), and the voltage at the second voltage output terminal is:

$$V_x=V_{BG}(R_4/R_3)+I_{PTAT}\cdot R_4 \quad (7),$$

where $V_x$ is a voltage at the second voltage output terminal x.

According to the equation (7), and as is known that $I_{PTAT}$ increases as the temperature rises, the voltage $V_x$ at the second voltage terminal x is equal to a sum of a temperature-independent voltage $C_3$, where $C_3=V_{BG}(R_4/R_3)$, and a voltage with positive temperature coefficient, i.e. $I_{PTAT}\cdot R_4$. Hence, the voltage $V_x$ at the second voltage output terminal x can be viewed as a PTAT voltage to be provided for next stage of the reference circuitry, i.e. the threshold voltage superposing circuit 300. It is understood that the circuit designer may use the resistance of the third resistor $R_3$ to provide an offset voltage to change $C_3$ and calibrate the voltage $V_x$.

Figure 6:
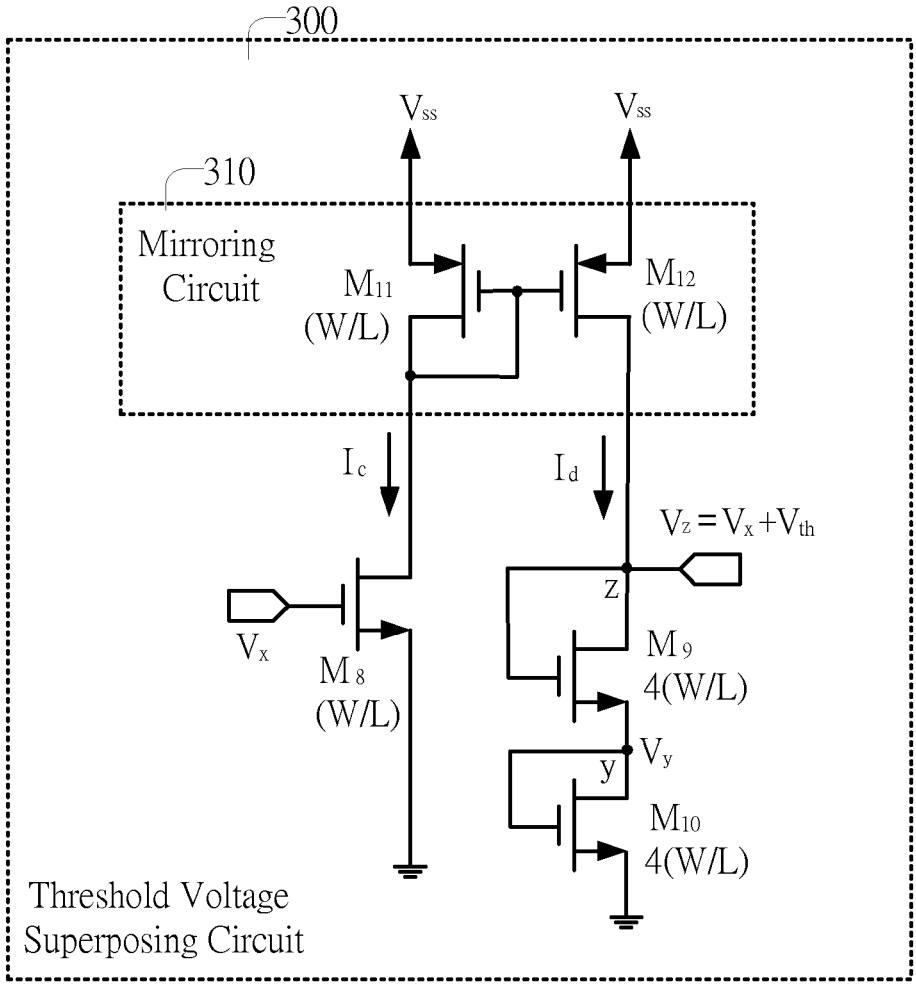
FIG. 6 is a diagram showing an embodiment of a threshold voltage superposing circuit applicable to the reference circuit of FIG. 3.

Please refer to FIG. 6. FIG. 6 is a diagram showing an embodiment of the threshold voltage superposing circuit 300. The threshold voltage superposing circuit 300 includes a third mirroring circuit 310, and three NMOS FETs $M_8$, $M_9$ and $M_{10}$. The NMOS FETs $M_8$, $M_9$ and $M_{10}$ have the same threshold voltage $V_{th}$; the NMOS FETs $M_9$ and $M_{10}$ have the same aspect ratio (W/L); and the aspect ratio of the NMOS FET $M_9$ is four times the aspect ratio of the NMOS FET $M_8$. The third mirroring circuit 310 includes two PMOS FETs $M_{11}$, and $M_{12}$. In this embodiment, the PMOS FET $M_{11}$, and $M_{12}$ have the same aspect ratio (W/L). The gates of the PMOS FETs $M_{11}$ and $M_{12}$ are connected to each other; the sources of the PMOS FETs $M_{11}$ and $M_{12}$ are connected to a power supply $V_{SS}$; the drain of the PMOS FET $M_{11}$ is connected to the gate of the PMOS FET $M_{11}$ and can be viewed as a first terminal of the third mirroring circuit 310; and the drain of the PMOS FET $M_{12}$ can be viewed as a second terminal of the third mirroring circuit 310. When the PMOS FETs $M_{11}$ and $M_{12}$ operate in saturation regions, the intensities of the currents outputted from the first terminal and the second terminal of the third mirroring circuit 310 are equal, i.e. $I_c=I_d$.

Moreover, the second voltage output terminal x of the positive temperature coefficient calibrating circuit 200 is connected to the gate of the NMOS FET $M_8$; the source of the NMOS FET $M_8$ is grounded; and the drain of the NMOS FET $M_8$ is connected to the first terminal of the third mirroring circuit 310. In addition, the second terminal of the third mirroring circuit 310 can be viewed as a third voltage output terminal z of the threshold voltage superposing circuit 300, and the diode-connected NMOS FETs $M_9$ and $M_{10}$ are cascaded between the third voltage output terminal z and ground.

When the NMOS FETs $M_8$, $M_9$ and $M_{10}$ in the threshold voltage superposing circuit 300 operate in saturation regions, the current $I_c$ is equal to $K(V_x-V_{th})^2$, where K is a device transconductance parameter or a manufacture parameter and has a feature of negative temperature coefficient. Due to the aspect ratio of the NMOS FET $M_{10}$ being four times the aspect ratio of the NMOS FET $M_8$ and $I_c=I_d$, the current $I_d$ is equal to $4K(V_y-V_{th})^2$, where $V_y$ is a voltage at a node "y" among the source of the NMOS FET $M_9$ and the gate and drain of the NMOS FET $M_{10}$ and $V_y=(V_x+V_{th})/2$. The voltage $V_z$ at the third voltage output terminal z is equal to $2V_y=2(V_x+V_{th})/2=V_x+V_{th}$. That is to say, the voltage $V_z$ at the third voltage output terminal z is equal to the voltage $V_x$ at the second voltage output terminal x of the positive temperature coefficient calibrating circuit 200 plus the threshold voltage $V_{th}$. The voltage $V_z$ is further provided to next stage of the reference circuitry, i.e. precision current generator 400.

Figure 7:
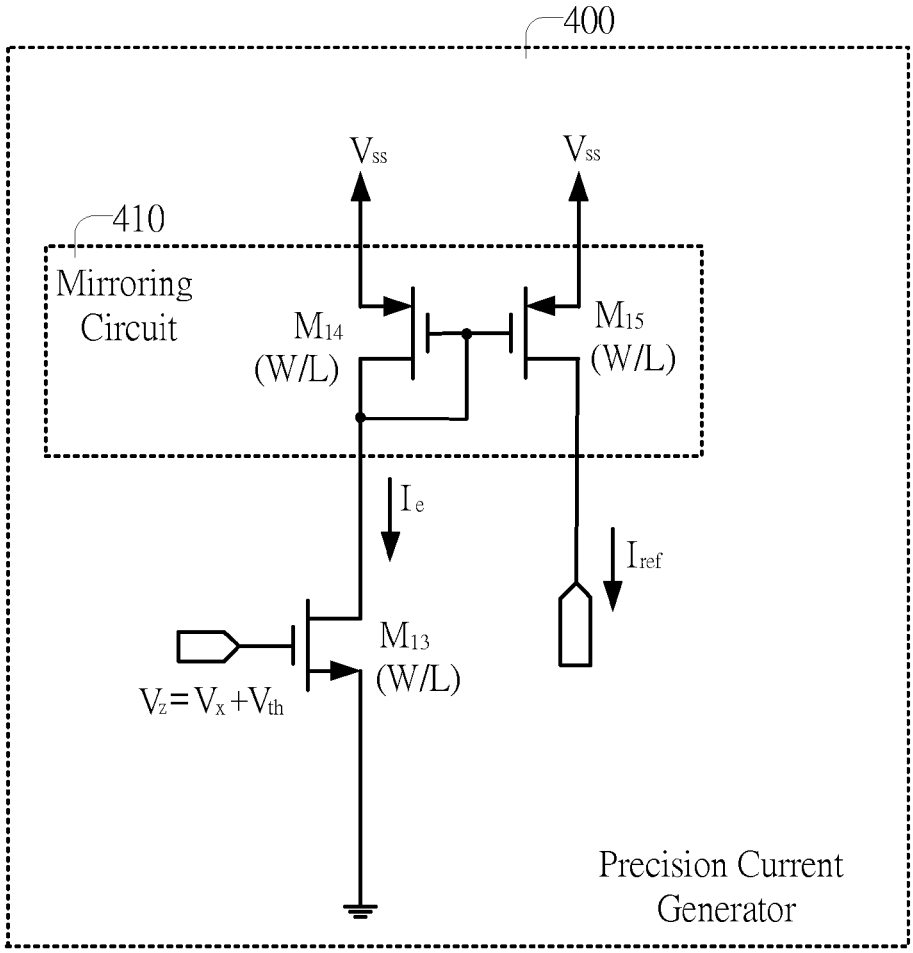
FIG. 7 is a diagram showing an embodiment of a precision current generator applicable to the reference circuit of FIG. 3.

Please refer to FIG. 7. FIG. 7 is a diagram showing an embodiment of the precision current generator 400. The precision current generator 400 includes a fourth mirroring circuit 410 and an NMOS FET $M_{13}$, wherein the NMOS FET $M_{13}$ has the same aspect ratio as the NMOS FET $M_8$ in the threshold voltage superposing circuit 300. The fourth mirroring circuit 410 includes two PMOS FETs $M_{14}$ and $M_{15}$. In this embodiment, the PMOS FETs $M_{14}$ and $M_{15}$ have the same aspect ratio; the gates of the PMOS FETs $M_{14}$ and $M_{15}$ are connected to each other; the sources of the PMOS FETs $M_{14}$ and $M_{15}$ are connected to the power supply $V_{SS}$; the drain of the PMOS FET $M_{14}$ is connected to the gate of the PMOS FET $M_{14}$ and can be viewed as a first terminal of the fourth mirroring circuit 410; and the drain of the PMOS FET $M_{15}$ can be viewed as a second terminal of the fourth mirroring circuit 410. When the PMOS FETs $M_{14}$ and $M_{15}$ operate in saturation regions, the intensities of the currents outputted from the first terminal and the second terminal of the fourth mirroring circuit 410 are equal, i.e. $I_e=I_{ref}$.

In this embodiment, the third voltage output terminal z of the threshold voltage superposing circuit 300 is connected to the gate of the NMOS FET $M_{13}$; the source of the NMOS FET $M_{13}$ is grounded; and the drain of the NMOS FET $M_{13}$ is connected to the first terminal of the fourth mirroring circuit 410.

When the NMOS FET $M_{13}$ in the precision current generator 400 operates in a saturation region, the current $I_{ref}$ and the current $I_e$ are the same and can be presented by the equation $I_{ref}=I_e=K(V_z-V_{th})^2=K(V_x+V_{th}-V_{th})^2=K\cdot V_x^2$. Since K exhibits the feature of negative temperature coefficient, as mentioned above, and the voltage $V_x$ exhibits the feature of positive temperature coefficient, a temperature-independent current $I_{ref}$ can be outputted from the second terminal of the fourth mirroring circuit 410 by appropriately adjusting the values of K and $V_x$. The resulting temperature-independent current $I_{ref}$ can thus be obtained as a precision current.

It is understood from the above descriptions that both a precision voltage and a precision current can be obtained by the reference circuit according to the present invention, which is disposed in an IC circuit without the need of any external resistor. Furthermore, by operating all the transistors of the reference circuit in saturation regions, deviations possibly occurring during the manufacturing process of the IC circuit can be remedied.

While the invention has been described in terms of what is presently considered to be the most practical and preferred embodiments, it is to be understood that the invention needs not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A reference circuit for providing both a precision voltage and a precision current, comprising:

a bandgap voltage reference circuit outputting a bandgap voltage as the precision voltage at a first voltage output terminal and outputting a proportional to absolute temperature (PTAT) current at a current output terminal in response to a power supply;

a positive temperature coefficient calibrating circuit connected to the first voltage output terminal and the current output terminal of the bandgap voltage reference circuit for generating a PTAT voltage at a second voltage output terminal in response to the bandgap voltage and the PTAT current;

a threshold voltage superposing circuit connected to the second voltage output terminal of the positive temperature coefficient calibrating circuit for generating a first voltage at a third voltage output terminal in response to the PTAT voltage, wherein the first voltage is generated according to the PTAT voltage plus a threshold voltage; and a precision current generator connected to the third voltage output terminal of the threshold voltage superposing circuit for outputting a reference current as the precision current at a reference current output terminal in response to the first voltage.

2. The reference circuit of claim 1, wherein the PTAT voltage is generated according to a temperature-independent voltage plus a voltage with a positive temperature coefficient.

3. The reference circuit of claim 1, wherein the bandgap voltage reference circuit comprises:

a first mirroring circuit having a first terminal, a second terminal, a third terminal for outputting the bandgap voltage and a fourth terminal which serves as the current output terminal for outputting the PTAT current;

a first operational amplifier having a positive input terminal connected to the second terminal of the first mirroring circuit and a negative input terminal connected to the first terminal of the first mirroring circuit;

a first resistor;

a second resistor;

a first BJT transistor, wherein the first resistor is connected between an emitter of the first BJT transistor and the second terminal of the first mirroring circuit;

a second BJT transistor having an emitter connected to the first terminal of the first mirroring circuit and a base and a collector grounded; and a third BJT transistor, wherein the second resistor is connected between an emitter of the third BJT transistor and the third terminal of the first mirroring circuit, and a base and a collector of the third BJT transistor are grounded;

wherein an area of the first BJT transistor is m times an area of the second BJT transistor.

4. The reference circuit of claim 3, wherein the first mirroring circuit comprises:

a first MOS field-effect transistor, a second MOS field-effect transistor, a third MOS field-effect transistor and a fourth MOS field-effect transistor;

wherein gates of the four MOS field-effect transistors are connected to each other, sources of the four MOS field-effect transistors are connected to the power supply, and drains of the four MOS field-effect transistors respectively serve as the first terminal, the second terminal, the third terminal and the fourth terminal of the first mirroring circuit.

5. The reference circuit of claim 1, wherein the positive temperature coefficient calibrating circuit comprises:

a first mirroring circuit having a first terminal and a second terminal which serves as the second voltage output terminal and is connected to the current output terminal for receiving the PTAT current;

a first operational amplifier having a positive input terminal connected to the first voltage output terminal of the bandgap voltage reference circuit;

a first MOS field-effect transistor having a source connected to a negative input terminal of the first operational amplifier, a drain connected to the first terminal of the first mirroring circuit, and a gate connected to an output terminal of the first operational amplifier;

a first resistor connected between the source of the first MOS field-effect transistor and ground; and a second resistor connected between the second terminal of the first mirroring circuit and ground.

6. The reference circuit of claim 5, wherein the first mirroring circuit comprises:

a second MOS field-effect transistor and a third MOS field-effect transistor;

wherein gates of the two MOS field-effect transistors are connected to each other, sources of the two MOS field-effect transistors are connected to the power supply, and drains of the two MOS field-effect transistors respectively serve as the first terminal and the second terminal of the first mirroring circuit.

7. The reference circuit of claim 1, wherein the threshold voltage superposing circuit comprises:

a first mirroring circuit having a first terminal and a second terminal which serves as the third voltage output terminal;

a first MOS field-effect transistor having a gate connected to the second voltage output terminal, a drain connected to the first terminal, and a source grounded;

a second MOS field-effect transistor having a gate and a drain connected to the second terminal of the first mirroring circuit; and a third MOS field-effect transistor having a gate and a drain connected to a source of the second MOS field-effect transistor, and a source grounded.

8. The reference circuit of claim 7, wherein the first mirroring circuit comprises;

a fourth MOS field-effect transistor and a fifth MOS field-effect transistor;

wherein gates of the two MOS field-effect transistors are connected to each other, sources of the two MOS field-effect transistors are connected to the power supply, and drains of the two MOS field-effect transistors respectively serve as the first terminal and the second terminal of the first mirroring circuit.

9. The reference circuit of claim 7, wherein an aspect ratio of the first MOS field-effect transistor is W/L, an aspect ratio of the second MOS field-effect transistor is 4(W/L), and an aspect ratio of the third MOS field-effect transistor is 4(W/L).

10. The reference circuit of claim 7, wherein the first MOS field-effect transistor, the second MOS field-effect transistor and the third MOS field-effect transistor have substantially equal threshold voltages.

11. The reference circuit of claim 1, wherein the precision current generator comprises:

a first mirroring circuit having a first terminal and a second terminal which serves as the reference current output terminal; and a first MOS field-effect transistor having a gate connected to the third voltage output terminal of the threshold voltage superposing circuit, a drain connected to the first terminal of the first mirroring circuit, and a source grounded.

12. The reference circuit of claim 11, wherein the first mirroring circuit comprises:

a second MOS field-effect transistor and a third MOS field-effect transistor;

wherein gates of the two MOS field-effect transistors are connected to each other, sources of the two MOS field-effect transistors are connected to the power supply, and drains of the two MOS field-effect transistors respectively serve as the first terminal and the second terminal of the first mirroring circuit.

* * * * *